US007299789B2

(12) United States Patent
Vierling et al.

(10) Patent No.: US 7,299,789 B2
(45) Date of Patent: Nov. 27, 2007

(54) FUEL INJECTION TIMER AND CURRENT REGULATOR

(75) Inventors: Lou Vierling, Eastpointe, MI (US); Shawn Lance Tracy, Macomb, MI (US); William Eli Hollowell, White Lake, MI (US)

(73) Assignee: Siemens VDO Automotive Corporation, Auburn Hills ( * ) Notice: Subject to any disclaimer, the term of this patent is extended or adjusted under 35 U.S.C. 154(b) by 0 days.

(21) Appl. No.: 11/132,021

(22) Filed: May 18, 2005

(65) Prior Publication Data

US 2005/0213277 A1 Sep. 29, 2005

Related U.S. Application Data

(62) Division of application No. 10/384,032, filed on Mar. 7, 2003, now Pat. No. 6,923,161.

(60) Provisional application No. 60/380,705, filed on May 15, 2002, provisional application No. 60/380,108, filed on May 6, 2002, provisional application No. 60/368,277, filed on Mar. 28, 2002.

(51) Int. Cl.
*F02M 51/00* (2006.01)

(52) U.S. Cl. ..... 123/490

(58) Field of Classification Search ..... 123/490, 123/478, 482, 476, 494; 361/152; 307/11, 307/43, 112, 130, 131
See application file for complete search history.

(56) References Cited

U.S. PATENT DOCUMENTS 4,092,717 A 5/1978 Di Nunzio ..... 701/115
4,694,238 A * 9/1987 Norton ..... 322/28
6,028,388 A * 2/2000 Shimada ..... 310/318
6,044,823 A * 4/2000 Watanabe ..... 123/490
6,305,358 B1 10/2001 Lukich ..... 123/502
6,359,796 B2 * 3/2002 Hartular et al. ..... 363/50
6,407,593 B1 6/2002 Kawamoto et al. ..... 327/110
6,518,733 B1 * 2/2003 Schenkel et al. ..... 320/166
6,601,567 B2 8/2003 Marceca et al. ..... 123/490
6,636,021 B2 * 10/2003 Schenkel et al. ..... 320/166
6,666,019 B2 12/2003 Kawatani et al. ..... 60/286
6,712,048 B2 * 3/2004 Aoki et al. ..... 123/490
6,832,356 B1 * 12/2004 Ochi ..... 716/1
6,917,227 B1 * 7/2005 Ochi ..... 327/111
6,940,736 B2 * 9/2005 Jonsson ..... 363/71
7,009,859 B2 * 3/2006 Chen et al. ..... 363/65
7,035,118 B2 * 4/2006 Jonsson ..... 363/17

(Continued)

FOREIGN PATENT DOCUMENTS

EP 0309755 4/1989

(Continued)

*Primary Examiner*—Hai Huynh

(57) ABSTRACT

A fuel injector control system and method provides precise fuel injection timing while eliminating the need for a voltage regulator by estimating or predicting ramp times between voltage application and actual fuel injection. In one embodiment, an estimated ramp time injection is calculated from a measured voltage and is used to delay or advance application of the voltage on the coil so that the load current reaches a desired current level at a desired injection start time. In another embodiment, an actual ramp time for a given injection is measured and used to predict future ramp times. A current regulator prevents excessive emissions from being generated when controlling the load current.

5 Claims, 6 Drawing Sheets

U.S. PATENT DOCUMENTS

| | | | | |
|---|---|---|---|---|
| 7,092,814 | B1 * | 8/2006 | Trenne et al. | 701/105 |
| 7,098,630 | B2 * | 8/2006 | Jonsson | 323/222 |
| 7,176,657 | B2 * | 2/2007 | Lee et al. | 320/166 |
| 2004/0051397 | A1 * | 3/2004 | Juntunen et al. | 307/130 |
| 2005/0022793 | A1 | 2/2005 | Takemoto | 123/480 |

FOREIGN PATENT DOCUMENTS

| | | |
|---|---|---|
| JP | 62-261644 | 11/1987 |
| JP | 10-82339 | 3/1998 |
| JP | 2000-257495 | 9/2000 |

* cited by examiner

FUEL INJECTION TIMER AND CURRENT REGULATOR

RELATED APPLICATIONS

The present application is a divisional of Ser. No. 10/384,032 filed on Mar. 7, 2003, now U.S. Pat. No. 6,923,161 which claims priority to U.S. Provisional Patent Application Ser. Nos. 60/368,277, 60/380,108, and 60/380,705, filed Mar. 28, 2002, May 6, 2002, and May 15, 2002, respectively.

TECHNICAL FIELD

The present invention relates to fuel injection systems, and more particularly to a system that determines an optimum timing for fuel injection. The invention is also related to a method for controlling injector current.

BACKGROUND OF THE INVENTION

Fuel injection systems operate by energizing coils and using those coils to move an electromagnet that opens a valve, allowing pressurized fuel to enter the cylinders of an engine. The coils in fuel injectors tend to have a large amount of inductance, causing a delay between the time voltage is applied to the coil and the time that the coil has sufficient current flow (e.g., 20 A) to actually begin fuel injection. The actual amount of the delay depends both on the inductance of the coil and the amount of voltage applied to the coil. The time delay between the leading edge of the forward pulse and the time the load current reaches the desired level is called the "ramp time."

If the voltage differs from a nominal voltage, the amount of time required for the load current in the coil to ramp up to the desired level will change as a result. For example, if the voltage applied to the coil is lower than the nominal voltage, the load current will increase more slowly than expected. Similarly, if the voltage is higher than the nominal voltage, the load current will increase more quickly. These changes can cause the load current to open the valve at a time other than an expected time calculated from the nominal voltage, making it difficult to maintain precise timing over fuel injector activation.

The inductance in the coil may also vary from a nominal inductance, further changing the actual time in which the load current reaches its desired level. Variations in the coil inductance also makes precise timing of fuel injection difficult. Although voltage regulators can be used to stabilize the voltage applied to the coil, voltage regulators are expensive and add complexity to the fuel injection system.

There is a desire for a system that can compensate for changes in the voltage and the coil inductance to ensure that the load current reaches the desired level at a desired time accurately.

SUMMARY OF THE INVENTION

The present invention is directed to a system and method that provides precise control over fuel injection while using an unregulated power supply. The description below explains two possible methods for adjusting fuel injection timing.

In one embodiment, an estimated ramp time between voltage application and the start of fuel injection is calculated from a measured voltage. The estimated ramp time corresponds to the time between application of the measured voltage and the time that the coil would reach a desired current level to start fuel injection. The estimated ramp time is then used to delay or advance application of the forward pulse to ensure that the load current reaches the desired level at a desired injection start time despite the deviation of the measured voltage from the nominal voltage.

In another embodiment, an actual ramp time for a given injection is measured and used to predict future ramp times. This embodiment takes the actual operation of the entire injector into account, not just the applied voltage, and can compensate for changes in the coil inductance as well as voltage fluctuations.

By eliminating the need for a regulated voltage supply and operating the fuel injector based on an estimated or predicted ramp time, the invention can time fuel injection precisely without requiring a voltage regulator, providing a simple and economical way to control fuel injection.

The invention is also directed to a method and system for controlling injector current. The voltage source that powers the fuel injector can be controlled by monitoring current flow in the injector. In a current regulator according to one embodiment of the invention, the current is regulated by selectively connecting the fuel injector with one of two possible voltage sources. This provides injector current regulation without having to turn a voltage source on and off (chopping).

DETAILED DESCRIPTION OF THE EMBODIMENTS

The inventive system and method generally involves adjusting the time at which voltage is applied to a coil in a fuel injection system to control the time at which fuel is actually injected into a cylinder of an engine. The description below provides two possible solutions for adjusting voltage application timing. The description below also provides one solution for adjusting load current.

Injection timing relies on the relationship between a nominal voltage applied as a forward pulse to an injector coil and the time delay, or "ramp time" between the forward pulse and the time at which a load current in the injector coil rises to a desired level in response to the applied voltage. When the load current reaches the desired level, the injector starts injecting fuel into the engine. The load current is then maintained for a selected pulse width to continue fuel injection, then allowed to drop back down to zero. Because fuel should be injected at precise times during the engine operating cycle, any deviation between the actual fuel injection timing from the optimum timing will adversely affect engine performance. As noted above, the inductive characteristics of the coil as well as variations in an unregulated voltage source may cause the fuel injector to release fuel before or after a desired injection start time.

FIGS. 1 through 4 illustrate ways in which the fuel injection timing can be made more precise without requiring a voltage regulator. Generally, the invention adjusts the timing of the forward pulse to compensate for voltages and/or coil inductances that are not equal to the nominal voltage and/or inductance. This timing adjustment in the forward pulse ensures that the load current will reach the desired level at the proper fuel injection start time. The invention can be implemented as an algorithm using any known device, such as a microprocessor.

Figure 1:
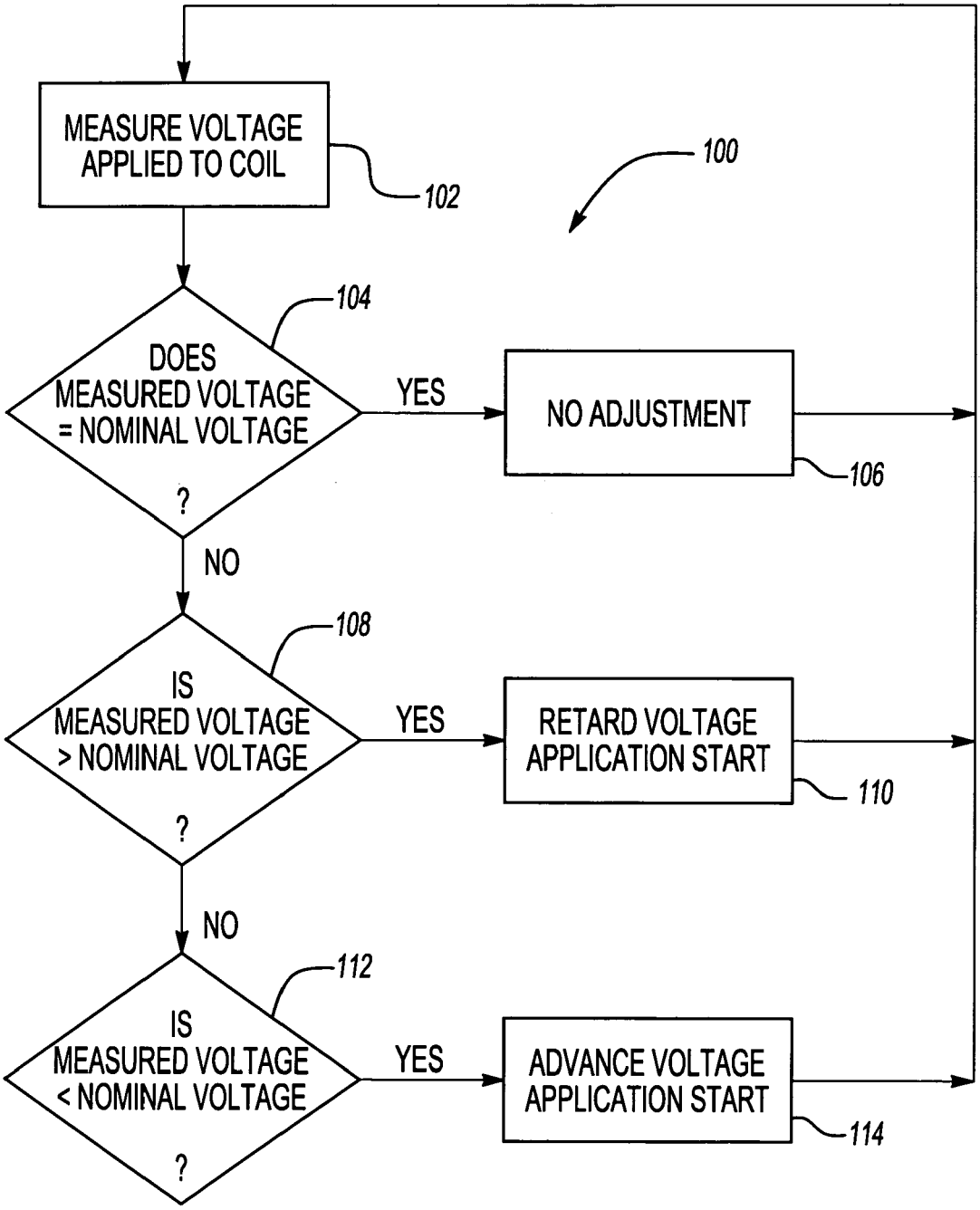
FIG. 1 is a block diagram illustrating a method for controlling injection timing according to one embodiment of the invention.
Figure 2A:
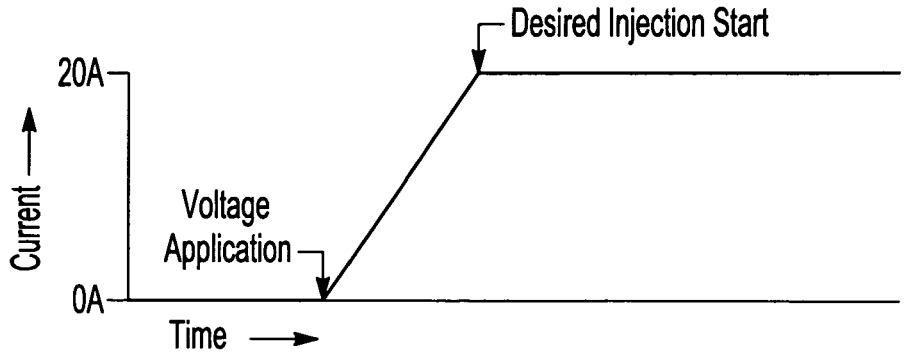
FIGS. 2A through 2C are timing diagrams illustrating a relationship between the applied voltage, a ramp time for a load current, and a desired injection start time for an applied voltage that is greater than a nominal voltage.
Figure 3A:
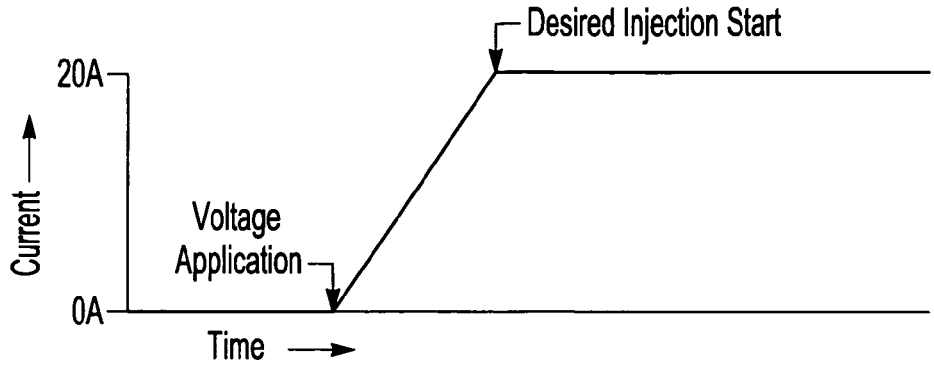
FIGS. 3A through 3C are timing diagrams illustrating a relationship between the applied voltage, a ramp time for a load current, and a desired injection start time for an applied voltage that is less than a nominal voltage.

FIG. 1 is a flowchart illustrating an adjustment method 100 according to one embodiment of the invention. In this embodiment, the voltage applied to the coil as a forward pulse is measured (block 102). The measured applied voltage is then compared with a nominal voltage. If the applied voltage and the nominal voltage are equal (block 104), this indicates that the load current will reach a desired level and start fuel injection at a proper time with the applied voltage (FIGS. 2A and 3A). The start time of the forward to the coil is therefore left unchanged in this case (block 106).

Figure 2B:
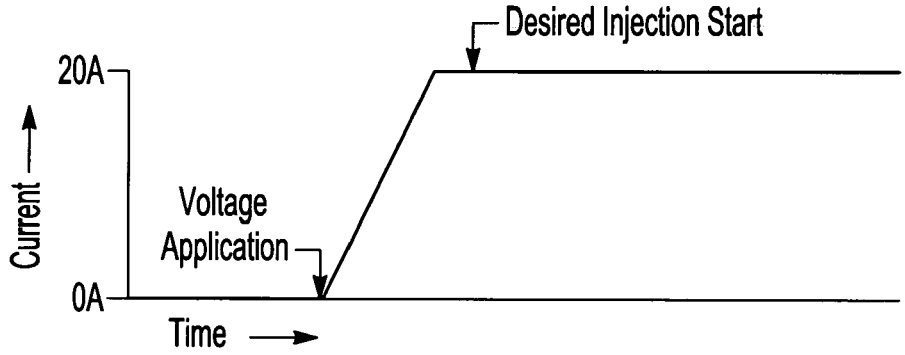
Figure 2C:
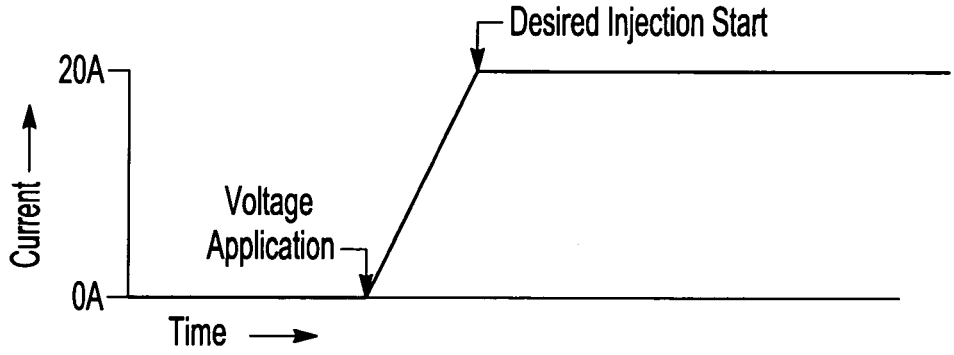

If the applied voltage is greater than the nominal voltage (block 108), the applied voltage will cause the load current in the coil to rise too quickly. As shown in FIG. 2B, the higher applied voltage will cause the ramp time of the load current to be too short due to the steeper slope of the current rise versus time, causing the load current to reach the desired level (20 A in this example) before the desired injection start time. As a result, the coil will cause fuel injection to start too early. To remedy this problem, the invention shifts the start time of the applied voltage (i.e., the forward pulse) to retard the start time (block 110). By retarding the start time of the forward pulse, the time at which the load current reaches desired 20 A level will coincide with the desired injection start time, as shown in FIG. 2C. In other words, the retarded start time of the forward pulse compensates for the decreased ramp time caused by the higher applied voltage.

Figure 3B:
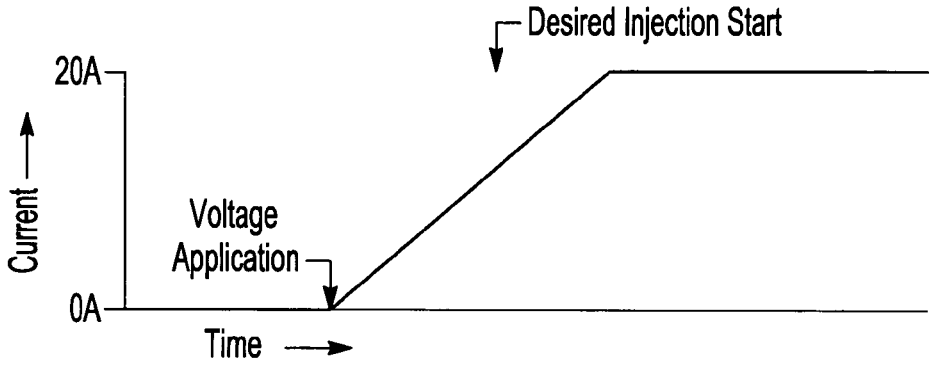
Figure 3C:
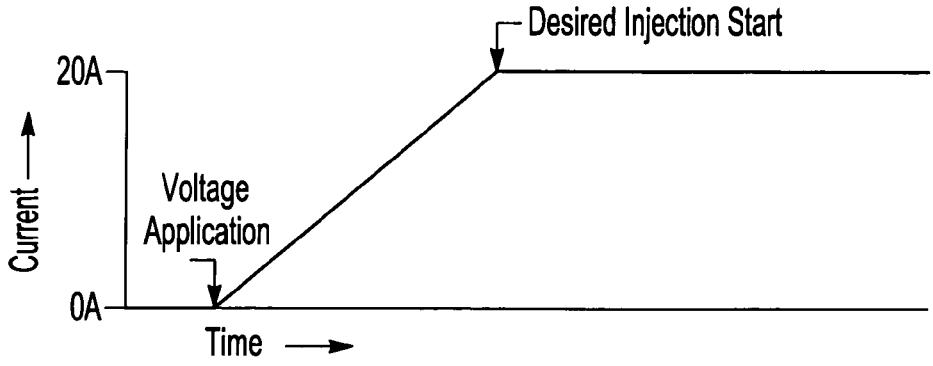

If the applied voltage is less than the nominal voltage (block 112), the applied voltage will cause the load current in the coil to rise too slowly. As shown in FIG. 3B, the lower applied voltage will cause the ramp time of the load current to be too long; the shallower slope of the current rise versus time causes the load current to reach 20 A after the desired injection start time. As a result, the coil will cause fuel injection to start too late. The invention shifts the start time so that the forward pulse starts sooner (block 114) so that the load current will reach the desired level at the desired injection start time, as shown in FIG. 3C. The earlier application of the forward pulse compensates for the increased ramp time caused by the lower applied voltage.

Figure 4:
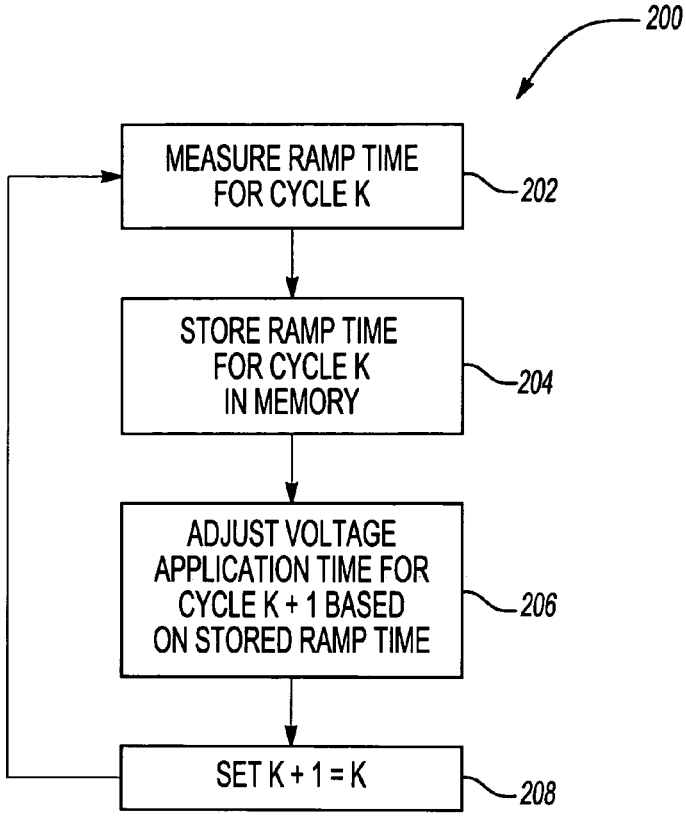
FIG. 4 is a block diagram illustrating another embodiment of the inventive method.

The embodiment described above adjusts the start time of the forward pulse based on the effect that the applied voltage has on the ramp time. A more direct way of adjusting the start time of the forward pulse is illustrated in FIG. 4. In this method 200, the fuel injector is first allowed to operate with no modifications to the timing of the forward pulse. The ramp time of the load current is measured (block 202) and is stored in memory (block 204). The stored ramp time is then used to predict the ramp time going forward and to adjust the timing of the forward pulse (block 206).

In one embodiment, the process 200 shown in FIG. 4 is conducted independently for individual coils, ensuring that the voltage application timing for each coil is based on the specific ramp time for that coil. This process may be repeated periodically; in the embodiment shown in FIG. 4, the ramp time is measured for each operating cycle so that the ramp time for the preceding cycle is used to adjust the voltage application time for the current cycle (block 206). The ramp time for the current cycle is then used to adjust the voltage application time for the next cycle (block 208), and this process is repeated continuously during fuel injection operation.

Because the ramp time depends on the applied voltage and the coil inductance, and because both the applied voltage and the inductance change slowly if at all, the ramp time for recent previous injection cycles, and particularly the immediately preceding injection cycle, is a good predictor of ramp times for an injection cycle in the immediate future. Again, by accurately predicting varying ramp times due to voltage supply variations, the invention can adjust the forward pulse to provide precise timing control over the injection start time, eliminating the need for a regulated voltage supply in the fuel injection system.

Figure 5:
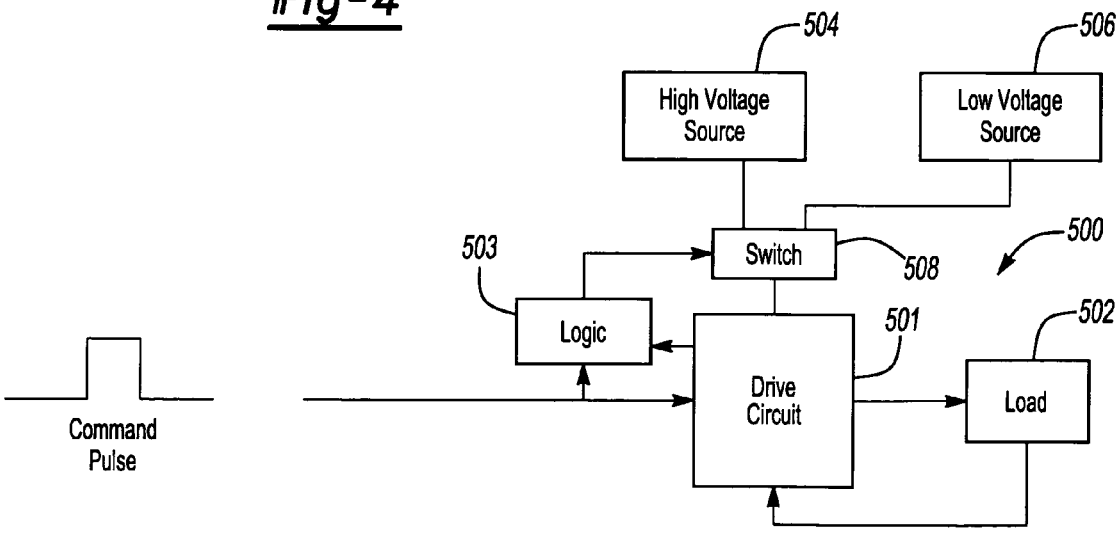
FIG. 5 is a representative diagram a current regulating circuit according to one embodiment of the invention.
Figure 6:
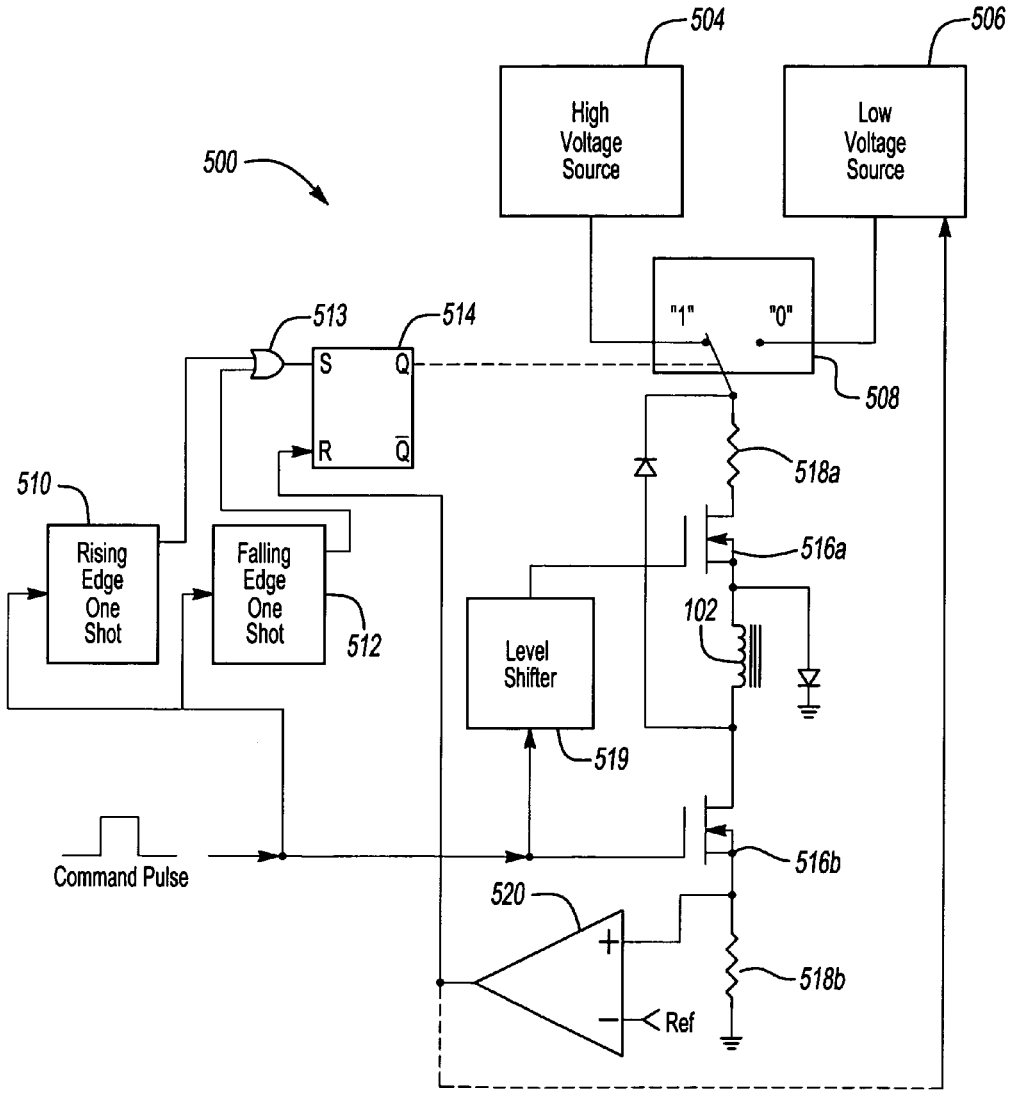
FIG. 6 illustrates the current regulating circuit of FIG. 5 in greater detail.
Figure 7:
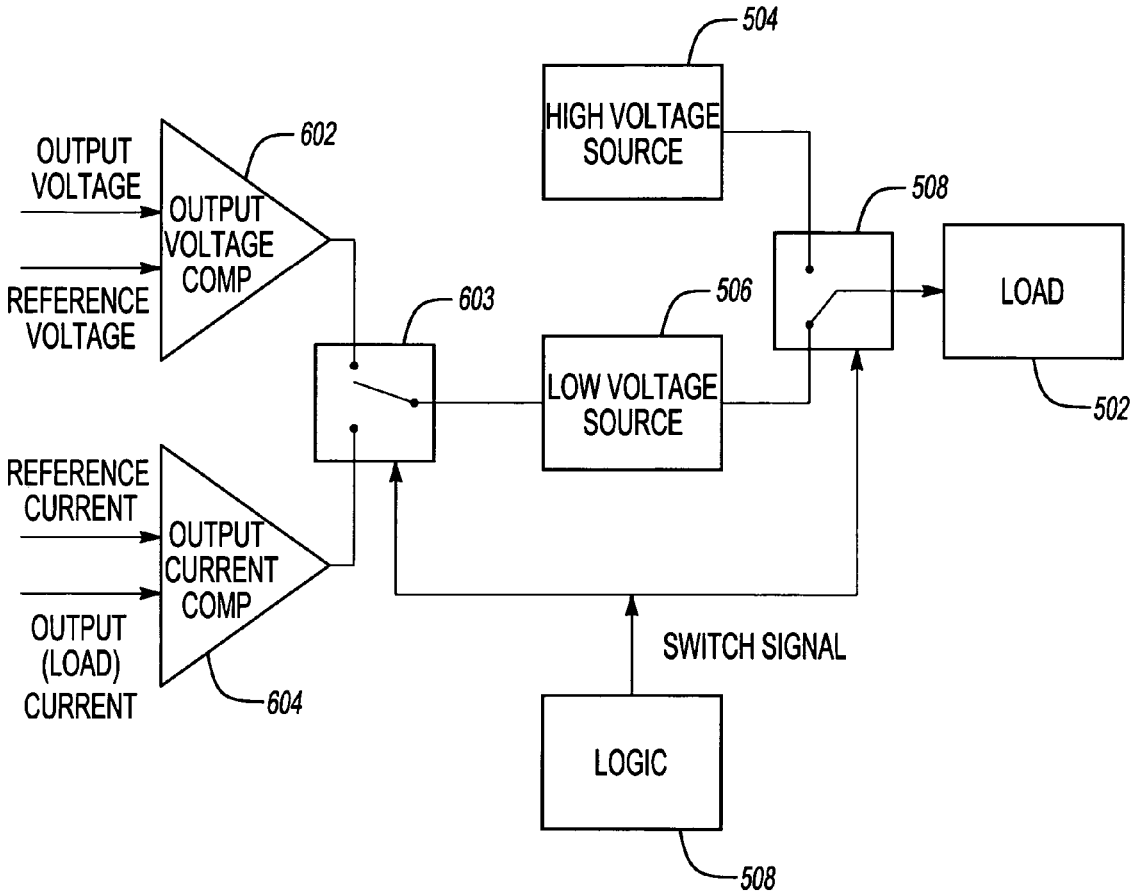
FIG. 7 is a representative diagram of a circuit used to sustain the load current in the circuit of FIG. 5 at a desired level.

FIGS. 5 through 7 illustrate one way in which the load current can be controlled. A proposed current regulator that can be used in conjunction with the inventive fuel injection timer is described in commonly-assigned, co-pending U.S. application Ser. No. 10/345,544 entitled "Current Regulator," filed Jan. 16, 2003, the disclosure of which is incorporated by reference in its entirety.

FIGS. 5 and 6 illustrate a current regulator 500 according to one embodiment of the invention. The current regulator 500 can control operation of any drive circuit 501 by controlling current through a load 502 with two voltage sources 504, 506 instead of a PWM signal, which causes undesirable emissions. In the illustrated embodiment, a command pulse from a microprocessor (not shown) enters the regulator 500 to control the load current flow through a load 502. In this example, the load 502 is an injector coil that starts and stops fuel injection. The command pulse itself is controlled based on, for example, commands from an engine controller (not shown) that determine how much fuel is needed at any given instant.

In this embodiment, a command pulse from a microprocessor (not shown) enters the regulator 500 to control the load current flow through a load 502. In this example, the load 502 is an injector coil that starts and stops fuel injection. The command pulse itself is controlled based on control logic 503 such as, for example, commands from an engine controller (not shown) that determine how much fuel is needed at any given instant.

Instead of relying on a PWM signal to control the current through the load, the inventive current regulator 500 has a high voltage source 504 and a low voltage source 506 that can be alternately connected into the current regulator 500 via a switch 508. The switch 508 will select one of the voltage sources 504, 506 at any given time based on the command pulse. In one embodiment, the high voltage source 504 has a value high enough to ensure that the current to the load 502 rises quickly to the reference level when it is selected, while the low voltage source 506 has a value to maintain the load current at a selected level. In general, the high voltage source 504 is selected at the rising edge of the command signal to raise the load current to the reference level and at the falling edge of the command signal to discharge the load current from the load 502 back to the high voltage source 504. The low voltage source 106 is selected when the desired load current has been achieved to maintain the load current at the reference level.

More particularly, as shown in FIG. 6, the command pulse is sent to a rising edge one shot device 510, which responds to a rising edge of the command pulse, and a falling edge one shot device 512, which responds to a falling edge of the command pulse. When a rising edge in the command pulse triggers the rising edge one shot device 510, the rising edge one shot device 510 sends an output through an OR gate 513 into a flip-flop 514. The flip-flop 514 generates an output to any known control mechanism to cause the switch 508 to select the high voltage source 504.

In this embodiment, high and low side switches 516*a*, 516*b* and high and low side shunts 518*a*, 518*b* connect the load 502 to the sources 504, 506. The high side switch 516*a* is controlled by a level shifter 519, which also receives the command pulse as an input. At this point, the command pulse turns on the low side switch 516*b* directly and turns on the high side switch 516*a* through the level shifter 519.

A comparator 520 monitors the load current and compares it with the reference level. In one embodiment, the comparator 520 is connected at the low side shunt 518*b*. The comparator 520 output remains high as long as the load current remains below the reference level. When the load current reaches the reference level, the comparator 520 output goes low, resetting the flip-flop 514. When the flip-flop 514 is reset, the switch 508 is switched to select the low voltage source 506 to maintain the load current at the reference level.

The switch 508 continues to select the low voltage source 506 until the command pulse switches from high to low. At that point, the falling edge of the command pulse triggers the falling edge one shot device 512. The falling edge one shot device 512 sends an output through the OR gate 513 and sets the flip-flop 514. The flip-flop 514 causes the switch 508 to select the high voltage source 504.

When the command pulse goes from high to low, the command pulse directly turns off the low side switch 516*b* and turns off the high side switch 516*a* via the level shifter 519. This, in combination with connecting the high voltage source 504, causes current to recirculate through the load 502 quickly and back into the high voltage source 504, ensuring that the load current drops rapidly. To enable current recirculation, diodes 522*a*, 522*b* are connected on the high side and the low side, respectively, of the load 502.

Thus, by switching between the two voltage sources 502, 504, the output of the regulator maintains the load current at a selected level without any chopping. Further, by switching a high voltage source and a low voltage source instead of simply connecting and disconnecting a high voltage source, the invention allows the load current to be maintained at a selected level without excessive switching; the low voltage source acts as a load current maintenance device.

Note that the control logic used to switch between the high and low voltage sources 504, 506 can also be used to control the operation of one or both of the voltage sources to reduce radio frequency emissions even further without compromising efficiency. As shown in FIG. 7, the low voltage source 506 may have two operating modes depending on whether or not the low voltage source 506 is loaded. A voltage comparator 602 and a current comparator 604 control the operating mode of the low voltage source 506 by dictating whether the low voltage source 506 is regulated by a voltage value or a current value. A switch 603 that is controlled by the same input as the source selecting switch 508 selects the control mode of the low voltage source 506.

More particularly, when the low voltage source 506 is disconnected from the load 502, the control logic 503 instructs the switch 603 to connect the low voltage source 506 to the voltage comparator 602. The voltage comparator 602 compares the output voltage (i.e., the voltage across the load 502) with a reference voltage (e.g., 20 V). The voltage comparator 602 output allows the circuit 500 to operate as long as the output voltage is at 20 V or less. If voltage across the exceeds the reference level, the voltage comparator 602 output inhibits operation of the circuit 500 until the output voltage drops back below the reference voltage level.

If the low voltage source 506 is connected to the load 502, the control logic 503 instructs the switch 603 to connect the low voltage source 506 with the output (load) current comparator 604. If the load current generated by the low voltage source 506 is below the reference current level (e.g., 20 A), the current comparator 604 allows operation of the circuit 500. If the load current rises above the reference current level, however, the comparator inhibits operation of the circuit 500 until the load current drops back below the reference current level. By making the operation of the low voltage source 506 dependent on the load current, the low voltage source 506 acts as an adaptive supply. Changes in the load resistance within a selected range, which would normally tend to change the load current, are compensated by raising or lowering the applied voltage by connecting and disconnecting the low voltage source 506 with the switch 603. As a result, the load current is kept constant despite changes in the load resistance.

Thus, the invention provides various ways to provide more accurate fuel injection timing by adjusting the voltage application time based on the ramp time, whether the ramp time is calculated from the applied voltage or measured directly. The invention also provides a circuit for controlling a power supply that sustains the output voltage and the load current at a desired level.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A current regulator that controls a load current through a load, comprising:

a high voltage source;

a low voltage source;

a first switch that selectively connects the high voltage source and the low voltage source to the load;

a second switch that controls a regulation mode of the low voltage source based on feedback dependent on a load current through the load; and a drive circuit that receives a command signal and controls the first switch and the second switch based on the command signal, wherein the first switch selects the first voltage source to change the load current and selects the low voltage source to maintain the load current, and wherein the second switch causes the low voltage source to be regulated by an output voltage across the load when the low voltage source is not connected to the load and causes the low voltage source to be regulated by the load current when the low voltage source is connected to the load.

2. The current regulator of claim 1, further comprising:

a voltage comparator; and a current comparator, wherein the second switch connects the voltage comparator to the low voltage source when the low voltage source is not connected to the load, and wherein the second switch connects the current comparator to the low voltage source when the low voltage source is connected to the load.

3. The current regulator of claim 2, wherein the voltage comparator inhibits operation of the current regulator when an output voltage across the load exceeds a reference voltage and wherein the current comparator inhibits operation of the current regulator when the load current exceeds a reference current.

4. The current regulator of claim 1, wherein said load comprises at least one fuel injector coil.

5. An adaptive voltage source for a current regulator for a load, comprising:

a voltage comparator;

a current comparator; and a switch that controls a regulation mode of the voltage source based on feedback dependent on a load current through the load, wherein the switch connects the voltage comparator to the low voltage source when the low voltage source is not connected to the load and connects the current comparator to the low voltage source when the low voltage source is connected to the load.

* * * * *